United States Patent [19]

Kocsis et al.

[11] 4,036,133

[45] July 19, 1977

[54] PRINTING PLATE CLAMPING ASSEMBLY

[75] Inventors: Alex Kocsis, Granger, Ind.; Gerald Kasner, Union, Mich.; Rudy Fermi, South Bend; David Bratton, Mishawaka, both of Ind.; John Pickard, San Antonio, Tex.

[73] Assignee: K & F Manufacturing Company, Inc., Granger, Ind.

[21] Appl. No.: 640,169

[22] Filed: Dec. 12, 1975

[51] Int. Cl.[2] ..... B41F 27/12

[52] U.S. Cl. ..... 101/415.1; 101/383

[58] Field of Search ..... 101/415.1, 378

[56] References Cited

U.S. PATENT DOCUMENTS

| | | | |
|---|---|---|---|
| 960,218 | 5/1910 | Droitcour | 101/415.1 |
| 2,123,997 | 7/1938 | Jirousek | 101/415.1 |
| 2,697,397 | 12/1954 | Bailey | 101/415.1 X |
| 2,916,990 | 12/1959 | Du Bois | 101/415.1 |
| 3,110,255 | 11/1963 | Jeschke et al. | 101/415.1 |
| 3,533,355 | 10/1970 | Wall | 101/415.1 |
| 3,696,744 | 10/1972 | Etchell | 101/415.1 |
| 3,791,295 | 2/1974 | Albright | 101/415.1 |
| 3,892,179 | 7/1975 | Jahn | 101/415.1 |
| 3,896,729 | 7/1975 | Moyer | 101/415.1 |
| 3,946,670 | 3/1976 | Cerny | 101/415.1 X |

*Primary Examiner*—Russell R. Kinsey
*Assistant Examiner*—Paul J. Hirsch
*Attorney, Agent, or Firm*—Craig & Antonelli

[57] ABSTRACT

Clamping apparatus is provided for clamping thin flexible printing plates in position on a press cylinder. A continuously spring biased rigid clamping member is engageable with a bent over portion of the trailing edge of the printing plate to clamp the same against the circumference of a printing press cylinder. In order to accommodate loading and unloading of printing plates on the clamping member, retaining straps are attached to the clamping member, which retaining straps are engageable with a release bar detent to lock the straps and clamping bar in a non-clamping position against the force of the clamping springs. The release bar is continuously spring biased to a locking position so that whenever the clamping bar is moved to the non-clamping position, the same is locked in said position. The release bar includes a manually operable push-button end portion for accommodating release of the release bar from the straps, whereby automatic movement of the clamping bar via the clamping springs to a clamping position is effected.

13 Claims, 2 Drawing Figures

PRINTING PLATE CLAMPING ASSEMBLY

BACKGROUND OF THE INVENTION

The present invention relates to printing plate clamping apparatus, and, more particularly, to apparatus for clamping flexible thin printing plates in position on a press cylinder. The present invention is primarily directed to an improved arrangement for clamping such thin flexible printing plates into position directly on the press cylinder, as well as on shim members, which shim members are detachably or non-detachably attached to a press cylinder for radially positioning the printing plate with respect to the surface of the press cylinder. Such shim members are utilized in conjunction with existing presses made for earlier used very thick lead stereotype plates. In other words, the shim members serve to account for the difference in thickness between the thin flexible plate now generally used and the earlier lead stereotype plates.

U.S. Pat. No. 3,791,295 to Albright discloses a known apparatus for clamping thin flexible printing plates on a press cylinder. In Albright, one extreme circumferential edge portion of the thin printing plate is clamped by a spring loaded clamping bar. In order to attach a printing plate to the saddle member of Albright, one must force the clamping bar against the springs to a non-clamping position, while one simultaneously places the thin printing plate in position to be clamped, at which time the clamping bar is released to resiliently clamp the printing plate. This Albright arrangement is disadvantageous in that it is very difficult, especially with thin flexible printing plates, to simultaneously hold the clamping bar in the non-clamping position and place the printing plate in a position to be clmped in a reliable manner.

The present invention overcomes the above-noted disadvantage, by providing a retaining system for retaining the clamp bar in a non-clamping position, which retaining system does not require continuous manual holding of the clamping bar in this non-clamping position. One can then have both hands free to place the printing plate in position to be clamped, after which a simple releasing operation accommodates the automatic resilient biasing of the clamping bar into the clamping position.

In preferred embodiments of the present invention, it is contemplated to provide retaining straps attached to the clamping bar, which retaining straps are engageable with a spring loaded release bar for locking said straps and clamping bar in the non-clamping position. The release bar is continuously spring biased in a locking direction such that, upon movement of the clamping bar to the non-clamping position, the release bar automatically locks the same in said non-clamping position. To accommodate release of the retaining mechanism, the release bar extends outwardly at one end of the press cylinder so as to be manually engageable at a push-button end thereof, whereby one merely needs to push against the release bar against the force of the spring and the retainer straps are released with the automatic movement of the clamp bar into engagement with the printing plate.

In a preferred embodiment of the present invention, the retainer straps are attached by screws to the clamp bar and extend away from the clamp bar in the circumferential direction of the saddle or press cylinder. At a position spaced from the clamp bar, the straps are provided with cutout detent grooves engageable by detent pin members carried by a release bar which extends transverse to the direction of movement of said straps and clamp bar. The release bar is spring loaded to force the detent pins thereof into the detent grooves in the retainer straps whenever the retainer straps are circumferentially aligned therewith. Also in preferred embodiments, the retainer straps are guided for movement by retainer screws extending through guide slots in the retainer straps.

Preferred embodiments of the invention are particularly adapted for use with saddle members that are detachably connected to the press cylinder. However, other preferred embodiments are contemplated where the clamping assembly and the retaining assembly are provided at the press cylinder itself, in instance the press cylinder is of a construction so that the saddle members are not needed to radially space the thin flexible printing plates.

These and further objects, features and advantages of the present invention will become more apparent from the following description, when taken in conjuction with the accompanying drawings and claims.

DETAILED DESCRIPTION OF THE DRAWINGS

Figure 1:
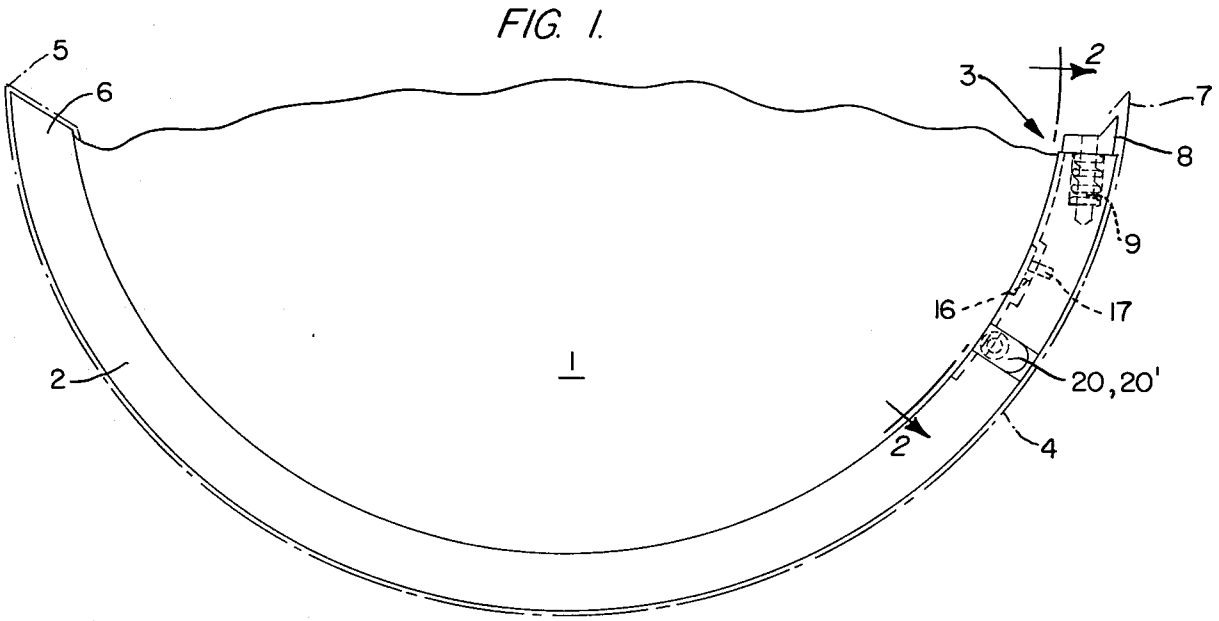
FIG. 1 is a schematic part-sectional view depicting a press cylinder with a saddle member attached thereto and having clamping apparatus for a thin flexible printing plate in accordance with a preferred embodiment of the present invention.

In both drawing figures, like reference numerals are used to depict like structure.

The following description and the drawing figures refer primarily to an embodiment with a saddle member formed separately of the press cylinder for radially spacing the printing plate with respect to the press cylinder surface. This embodiment is contemplated with press cylinders, usually press cylinders originally made for thick lead stereotype plates, having a diameter too small to properly radially position the thin flexible printing plates. However, other preferred, non illustrated embodiments of the invention are contemplated for use with press cylinders which do not require or use saddle members, such other embodiment being similar to those illustrated and described herein, except that the clamping apparatus is formed in the press cylinder structure, rather than in the separate saddle member.

Referring to the drawings, a printing press cylinder 1, of otherwise conventional construction, is provided with a saddle member 2 and a clamping assembly 3 constructed according to the present invention. Saddle member 2 extends circumferentially around the press cylinder 1 and is attached to said press cylinder 1 by connecting means, not shown, such as by threaded bolts set in counter-sunk slotted apertures, as well as by clamping mechanisms (also not shown as of conventional construction) of the type conventionally used for the old lead stereotype plates. Although only saddle member 2 and clamping assembly 3 are shown in the drawings, it will be understood that the invention also contemplates provision of further sets of saddle members and clamping assemblies along the axial and circumferential length of the press cylinder 1 so as to accommodate the particular printing requirements.

A thin flexible printing plate 4 is shown in FIG. 1 as being in engagement with the outer circumferential surface of the saddle 2. This printing plate 4 is to be constructed of a very thin plastic, or plastic coated metal material, and includes the printing impression on the outer circumferential surface thereof. Since, other than the particular aperture and bending arrangement for accommodating the clamping to the apparatus of the present invention, such flexible printing plates are of known construction, this description will only include details pertinent to the present invention. The printing plate 4 has a leading edge 5 which is bent back upon itself to form a lip which engages with correspondingly configured edge portion 6 of the saddle member 2.

The trailing edge 7 of the printing plate 4 is clampingly engageable by clamp bar 8 (in FIG. 1, clamp bar 8 is shown in a non-clamping position moved against the force of biasing springs 9, which biasing springs 9 continuously bias the clamp member 8 in a clamping direction so that the same would engage in the bent over portion 7 at the trailing edge of the plate 4). Guide dowels or pins 10 are attached to the clamp bar 8 to assist in guiding movement of the clamping bar 8 between the clamping and non-clamping positions, said guide pins 10 engaging in corresponding guide apertures 11 at the saddle 2. The springs 9 are sprial springs mounted in openings 12 in the saddle, and engaged with pin members 13 attached to the clamp bar 8 for continuously biasing the clamp bar 8 in the clamping direction.

Figure 2:
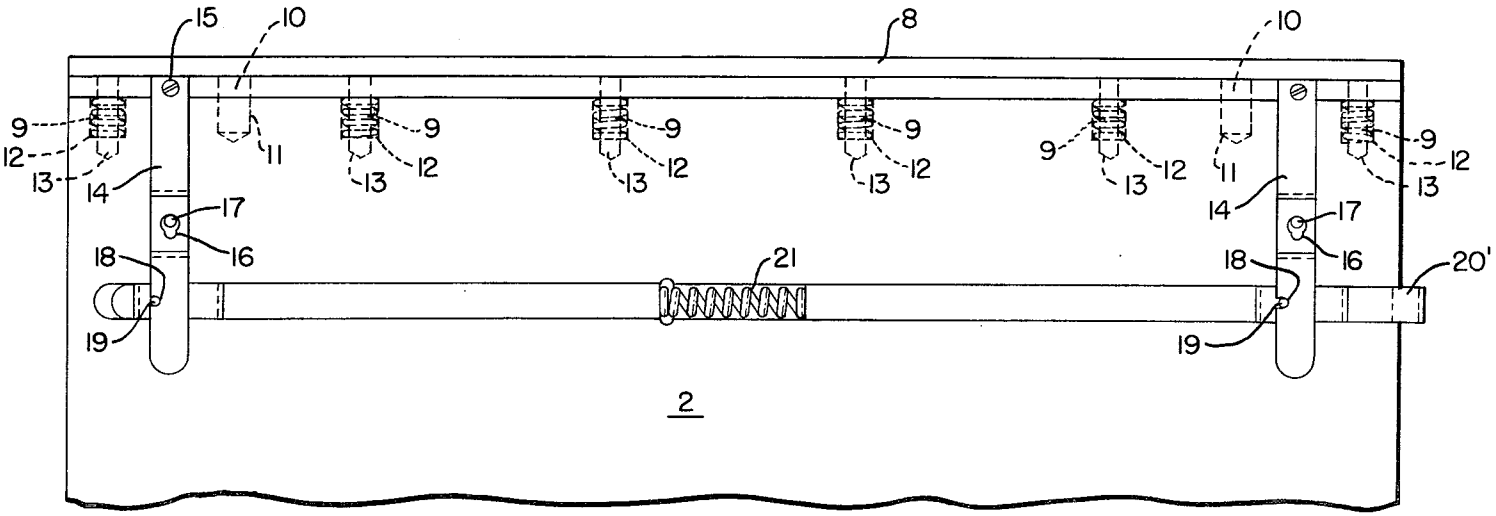
FIG. 2 is a radial view taken in the direction of arrow II of FIG. 1, which schematically depicts the configuration of the clamping apparatus of FIG. 1.

Adjacent respective opposite ends of the clamp bar 8, retainer straps 14 are attached thereto by screw members 15 so as to move in the circumferential direction upon movement of the clamp bar 8 between clamping and non-clamping position. Each of these retainer straps 14 include a guide slot 16 through which extends guide screws 17 for guiding the movement of the straps 14 in the circumferential direction of the saddle 2. Each of the straps 14 also includes a cutout groove 18 as the lefthand edge thereof as seen in the FIg. 2 illustration, which cutout groove 18 is engageable over release bar pins 19 carried by release bar 20. Release bar 20 is continuously spring biased in a direction toward the right as viewed in FIG. 2 by release bar retainer spring 21 so that whenever the circumferential position of grooves 18 and pins 19 are the same, they are spring biased into a locking position to hold the clamp bar 8 in a fixed non-clamping position (position as shown in FIG. 1).

The far righthand end of the release bar 20 includes a push-button portion 20' protruding axially out of the end of the press cylinder and/or saddle 2 so as to facilitate manual movement of the release bar 20 against the force of spring 21.

Although the attachement and detachement of a printing plate 4 to and from the above described apparatus should be readily apparent from the above description and the drawings, following is a summary of said operations, First, one pushes the rigid clamp bar 8 against spring 9 into the non-clamping position shown in FIGS. 1 and 2, at which time the spring loaded release bar 20 will effect a locking of the clamp bar 8 into this non-clamping position by way of the interengageable detents 18 and 19. That is, the clamp bar 8 is maintained in the non-clamping position, without the need for any additional manual forces being applied thereat. One then merely slips the leading edge 5 of plate 4 over the edge portion 6 of saddle 2. Once the leading edge 5 is positioned as described, and appropriately aligned in the axial direction of the press cylinder 1, one merely need rotate the press cylinder while holding the outer circumference of the printing plate against the outer circumference of the saddle 2 to bring the trailing edge 7 adjacent the clamping assembly. Since the clamp bar 8 is maintained in the non-clamping position shown in the drawings, it is relatively simple for the trailing edge 7 of the printing plate 4 to be moved into a position for accommodating the clamp bar 8. With the trailing edge 7 in such a clamp bar accommodating position, one need merely depress the push-button end portion 20' of release bar 20, at which time the interengageable detents 18 and 19 will become disengaged and the springs 9 will automatically force the clamp bar 8 into clamping engagement with said trailing edge 7 to resiliently clamp the printing plate into position. For disassembly, one need merely reverse the above operation, by first moving the clamp bar 8 to the non-clamping position, wherein it will be automatically held by the interengaging detents 18 and 19 due to the spring biasing caused by spring 21 against release bar 20, Subsequent thereto, one can remove the printing plate in a simple manner since the clamp bar 8 is maintained completely in the non-clamping position.

In the preferred illustrated embodiment, the clamp bar 8 is constructed with a simple undercut edge configuration for engaging a similarly configured trailing edge portion 7 of the plate 4. However, the present invention also contemplates arrangements wherein the clamp bar includes detent means for engaging in apertures in the trailing edge 7, as well as embodiments with axial means for aligning the plate 4 in the axial direction of the press cylinder 1.

As can be seen in the FIG. 1 illustration, the saddle 2 is grooved to accomodate the straps 16 (including the enlargement adjacent the guide groove and screw 16, 17, provided for reinforcing purposes), said grooving assuring a firm attachment of the saddle 2 to the press cylinder 1, without interference from the clamping bar and retaining assembly and also aiding in guiding movement of straps 16.

While we have shown only a single embodiment and have described only several embodiments in accordance with the present invention, it is understood that the same is not limited thereto but is suseptible of numerous changes and modifications as would be known to those skilled in the art, given the present disclosure, and we therefore do not wish to be limited to the details shown and described herein but intend to cover all such changes and modifications as are encompassed by the scope of the appended claims.

We claim:

1. Apparatus for releasably clamping a plate edge portion of thin flexible printing plate to press cylinder means with said printing plate supported in an in-use printing position on a circumferential surface of said press cylinder means; said apparatus including:

clamp members movable between a clamping position with said clamp member means clampingly engaged in plate detent means of said plate edge portion and a non-clamping position out of clamping engagement with said plate detent means, biasing means for biasing said clamp members means toward said clamping position, clamp member retaining means movable between a retaining position lockingly retaining said clamp member means in said non-clamping position against the force of said biasing means and a non-retaining position permitting said clamp member means to move toward said clamping position, and retainer release means for accommodating selective manual movement of said retaining means from said retaining position to said non-retaining position, said clamp member retaining means including a retaining strap member attached to and movable with said clamp member means and extending in a generally circumferential direction when in an in-use position on a press cylinder means, said restraining strap member including strap member means, said retainer release means including a release bar extending transversely to said retaining strap member and having release bar detent means, said release bar being movable between a locking position with said release bar detent means engaged with said strap member detent means to hold said clamp member means in a non-clamping position and a release position with said release bar detent means released from said strap member detent means to permit movement of said retaining strap member and said clamp member means toward the clamping position.

2. Apparatus according to claim 1, wherein two of said retaining strap members are provided which are spaced from one another in the axial direction of the press cylinder means.

3. Apparatus according to claim 2, wherein said strap member detent means includes a detent notch in each of said retaining strap members, and wherein said release bar detent means includes a pair of detent pins engageable one each with respective ones of said detent notches.

4. Apparatus according to claim 3, wherein said detent notches are both open toward one axial direction of the press cylinder means.

5. Apparatus according to claim 4, wherein retainer spring means are provided for continuously biasing said release bar in an axial direction corresponding to movement of said detent pins into said detent notches.

6. Apparatus according to claim 1, further comprising press cylinder means in the forms of a press saddle member, and wherein said at least one strap member and said release bar are guided for movement in respective radially inwardly open grooves in said saddle member.

7. Apparatus according to claim 5, further comprising press cylinder means in the forms of a press saddle member, and wherein said at least one strap member and said release bar are guided for movement in respective radially inwardly open grooves in said saddle member.

8. Apparatus according to claim 1, wherein said retaining means includes retainer spring means for continuously forcing said release bar in a direction towards its locking position.

9. Apparatus according to claim 8, wherein said retaining strap member is a flexible flat strap, said strap member detent means including a detent notch in said flat strap, said release bar detent means including detent pin means carried by said releasing bar and engageble in said detent notch.

10. Apparatus according to claim 9, wherein said two of said flexible flat straps are provided which are spaced from one another in the axial direction of said press cylinder means.

11. Apparatus according to claim 10, wherein said retainer release means includes push-button means at one end of said release bar for accommodating manual movement of said release bar against the force of said retainer spring means out of locking engagement with each of said flat straps, whereby, upon pushing of said push-button means, said biasing means automatically moves said clamp member means toward said clamping position.

12. Apparatus according to claim 11, wherein said biasing means includes clamping spring means which continuously push said clamp member means in a circumferential direction toward said clamping position.

13. Apparatus according to claim 8, wherein said retainer release means includes manually engageable means for manually moving said release bar against the force of said retainer spring means.

* * * * *